US008172640B2

(12) United States Patent
Tanaka et al.

(10) Patent No.: US 8,172,640 B2
(45) Date of Patent: May 8, 2012

(54) EYEGLASS LENS PROCESSING APPARATUS

(75) Inventors: Motoshi Tanaka, Gamagori (JP); Kenichi Inaishi, Okazaki (JP); Ryoji Shibata, Toyokawa (JP)

(73) Assignee: Nidek Co., Ltd., Aichi (JP)

( * ) Notice: Subject to any disclaimer, the term of this patent is extended or adjusted under 35 U.S.C. 154(b) by 861 days.

(21) Appl. No.: 12/185,313

(22) Filed: Aug. 4, 2008

(65) Prior Publication Data

US 2009/0036025 A1 Feb. 5, 2009

(30) Foreign Application Priority Data

Aug. 3, 2007 (JP) ..... P.2007-203472

(51) Int. Cl.
*B24B 55/12* (2006.01)

(52) U.S. Cl. ..... 451/5; 451/43; 451/256

(58) Field of Classification Search ..... 451/43, 451/255, 256, 5, 53, 449, 60
See application file for complete search history.

(56) References Cited

U.S. PATENT DOCUMENTS 2,276,824 A * 3/1942 Carruthers ..... 494/1
6,790,124 B2 9/2004 Shibata
7,338,426 B2 * 3/2008 Samways ..... 494/10
2002/0006769 A1 * 1/2002 Tsuihiji et al. ..... 451/53

FOREIGN PATENT DOCUMENTS

| | | | |
|---|---|---|---|
| JP | 2002-283236 | A | 10/2002 |
| JP | 2003-156718 | A | 5/2003 |
| JP | 2003145328 | A | 5/2003 |
| JP | 2004-243452 | A | 9/2004 |
| JP | 2005-153134 | A | 6/2005 |

* cited by examiner

*Primary Examiner* — Robert Rose
(74) *Attorney, Agent, or Firm* — Sughrue Mion, PLLC

(57) ABSTRACT

An eyeglass lens processing apparatus includes: a processing apparatus body for processing a lens, which includes a grinding water supply unit for ejecting grinding water to a portion to be processed of the lens; a centrifugal separator which separates processing refuse from grinding water by rotating a dewatering bin to discharge the grinding water to the outside of the dewatering bin; and a calculation control unit which includes a counter for multiplying a processing refuse amount of the lens on the basis of a control signal of the apparatus and a memory for storing a processing refuse extraction reference provided to maintain filtering efficiency of the dewatering bin, the processing refuse extraction reference being determined on the basis of the multiplied processing refuse amount of the lens, and which generates an alarm signal when the multiplied processing refuse amount of the lens reaches the processing refuse extraction reference.

5 Claims, 6 Drawing Sheets

EYEGLASS LENS PROCESSING APPARATUS

BACKGROUND OF THE INVENTION

The present invention relates to an eyeglass lens processing apparatus having a processing apparatus body for processing a peripheral edge of an eyeglass lens by use of a grindstone and a centrifugal separator for separating processing refuse (waste) and grinding water from drainage discharged from the processing apparatus body.

Upon processing the eyeglass lens, cooling grinding water is supplied to a contact portion between the grindstone and the lens. Processing refuse produced during the processing of the lens is discharged from the processing apparatus body together with the grinding water. Since drainage discharged from a processing chamber contains the processing refuse, it is necessary to separate the processing refuse from the grinding water. For this reason, a centrifugal separator is known, which is used to discharge the grinding water to the outside of a dewatering bin in such a manner that the dewatering bin into which the grinding water is introduced is rotated to separate the processing refuse from the grinding water (JP-A-2004-243452 and JP-A-2005-153134).

Incidentally, in the eyeglass lens processing apparatus using the centrifugal separator, it is necessary to appropriately maintain or manage a filtering state of the grinding water and a dewatering state of the processing refuse without discharging the drainage containing the processing refuse from the dewatering bin as much as possible. For example, it is necessary to extract and collect the processing refuse from the dewatering bin before a large amount of the processing refuse are accumulated in the dewatering bin to thereby considerably deteriorate a filtering performance. However, when the extraction of the processing refuse is not carried out at an appropriate timing, the grinding water is not filtered, and hence the dirty drainage is directly introduced into a tank for storing the grinding water. When the dirty drainage is introduced into the tank, a problem arises in that bubbles overflow from the tank. Further, when the processing refuse are mixed with the grinding water supplied during the processing process, a problem arises in that a lens surface cannot be processed with high precision.

Additionally, in the centrifugal separator, the dewatering bin starts to rotate after the drainage is introduced from the processing apparatus body into the dewatering bin. At this time, since the dewatering bin cannot rotate at the maximum rotating speed at the beginning of the rotation, at the first stage, the filtering efficiency and the dewatering efficiency are low. For this reason, when a large amount of drainage is continuously introduced, the drainage may easily overflow in a state where the processing refuse are not sufficiently separated therefrom. Additionally, when the rotation of the dewatering bin stops at a stage when the processing of the lens ends, the dewatering bin is in a state where the water is filled therein. As a result, since the processing refuse attached to a wall surface of the dewatering bin are dissolved in the water, a problem arises in that the next rotation becomes unstable or the processing refuse cannot be easily extracted.

SUMMARY OF THE INVENTION

The present invention is made in consideration of the above-described problems, and a technical object of the invention is to provide an eyeglass lens processing apparatus capable of maintaining or managing a filtering state of grinding water and a dewatering state of processing refuse so that drainage containing the processing refuse is not discharged from a centrifugal separator as much as possible.

In order to achieve the above object, the present invention provides the following arrangements.

(1) An eyeglass lens processing apparatus comprising:

a processing apparatus body which includes, a lens rotation unit having a lens chuck shaft for holding and rotating a lens, a movement unit for changing an axis-to-axis distance between the lens chuck shaft and a grindstone rotating shaft by relatively moving the lens chuck shaft with respect to the grindstone rotating shaft, and a grinding water supply unit having a nozzle for ejecting grinding water to a portion to be processed of the lens;

a centrifugal separator which includes a dewatering bin for receiving the grinding water containing processing refuse via a drainage port of the processing apparatus body and a drainage pipe and a motor for rotating the dewatering bin, and which separates the processing refuse from the grinding water by rotating the dewatering bin so as to discharge the grinding water to an outside of the dewatering bin;

a calculation control unit which includes a counter for multiplying an amount of the processing refuse on the basis of a predetermined control signal of the apparatus and a memory for storing an extraction reference of the processing refuse provided to maintain filtering efficiency of the dewatering bin, and which generates an alarm signal when the multiplied processing refuse amount reaches the processing refuse extraction reference;

an alarm unit which alarms that the processing refuse collected in the dewatering bin need to be extracted on the basis of the alarm signal by use of a buzzer and/or a display; and a reset signal input switch which inputs a reset signal for resetting the multiplied processing refuse amount of the counter.

(2) The eyeglass lens processing apparatus according to (1), wherein the counter multiplies the processing refuse amount by counting the number of the processed lenses, the number of the processed lenses being counted on the basis of the control signal.

(3) The eyeglass lens processing apparatus according to (1), wherein the centrifugal separator includes an openable cover which is disposed on an upper portion of the dewatering bin and a detection unit which detects an open/close state of the cover, and wherein the eyeglass lens processing apparatus further comprises a reset signal input control unit which enables the input of the reset signal after the detection unit inputs a detection signal indicating that the cover is opened.

(4) The eyeglass lens processing apparatus according to (3), wherein the reset signal input control unit enables the input of the reset signal for a predetermined period after the detection unit inputs the detection signal indicating that the cover is opened.

(5) The eyeglass lens processing apparatus according to (3), wherein the reset signal input control unit enables the input of the reset signal for a period until a predetermined signal is input when the processing of the lens starts or for a period until a predetermined control signal for starting the processing of the lens is input, after the detection unit inputs the detection signal indicating that the cover is opened.

(6) The eyeglass lens processing apparatus according to (1) further comprising a motor control unit which starts the motor to be driven on the basis of a predetermined signal before the processing of the lens starts and allows the motor to be driven for a predetermined extra time after the processing of the lens ends.

DETAILED DESCRIPTION OF PREFERRED EMBODIMENTS

Figure 1:
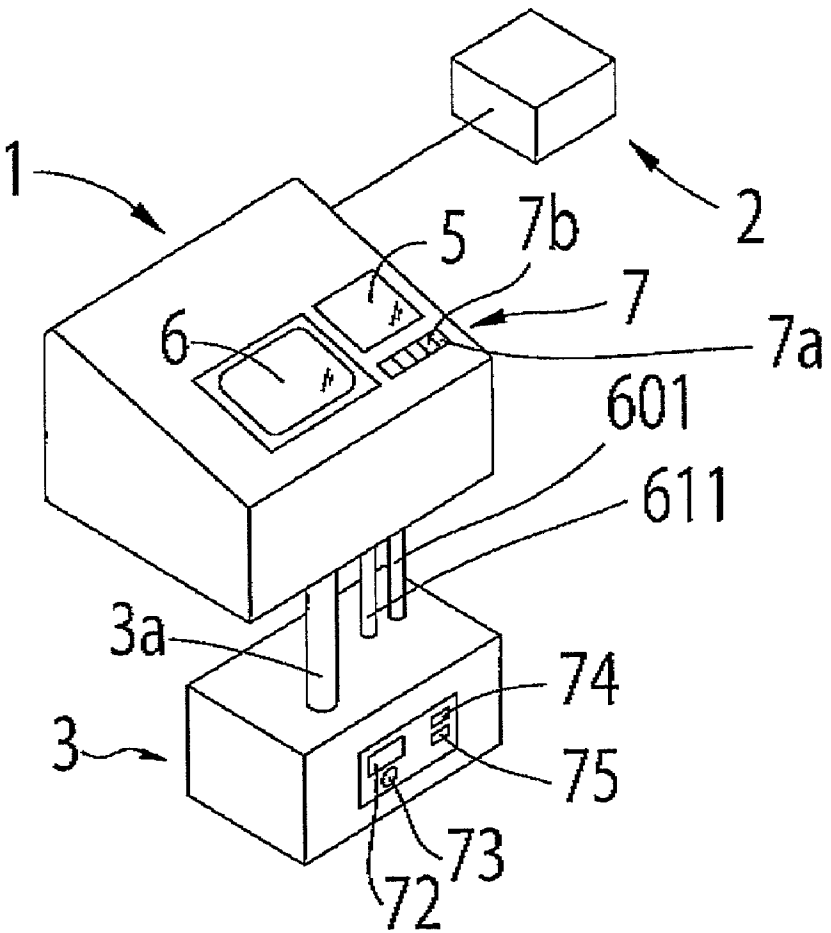
FIG. 1 is an external configuration diagram showing an eyeglass lens edge processing apparatus.

Hereinafter, an exemplary embodiment of the invention will be described. FIG. 1 is a diagram showing an external configuration of an eyeglass lens processing apparatus according to the invention. Reference numeral 1 denotes an eyeglass lens processing apparatus body. An eyeglass frame shape measurement device 2 is connected to the processing apparatus body 1. As the eyeglass frame shape measurement device 2, for example, the measurement device disclosed in JP-A-H05-212661 may be used. The upper portion of the processing apparatus body 1 is provided with a switch unit 7 for setting or starting the processing and a display unit 5 for displaying a processing condition or an eyeglass shape of a lens. The display unit 5 has a function of a touch panel, and serves as display means for displaying processing information, etc. and input means for inputting data or processing condition. Reference numeral 6 denotes an openable window for a processing chamber.

A water treatment device 3 having a centrifugal separator 650 as a filter device is disposed below the processing apparatus body 1. Processing refuse and grinding water used in the processing apparatus body 1 are introduced into the water treatment device 3 via a drainage pipe 3*a*.

Figure 2:
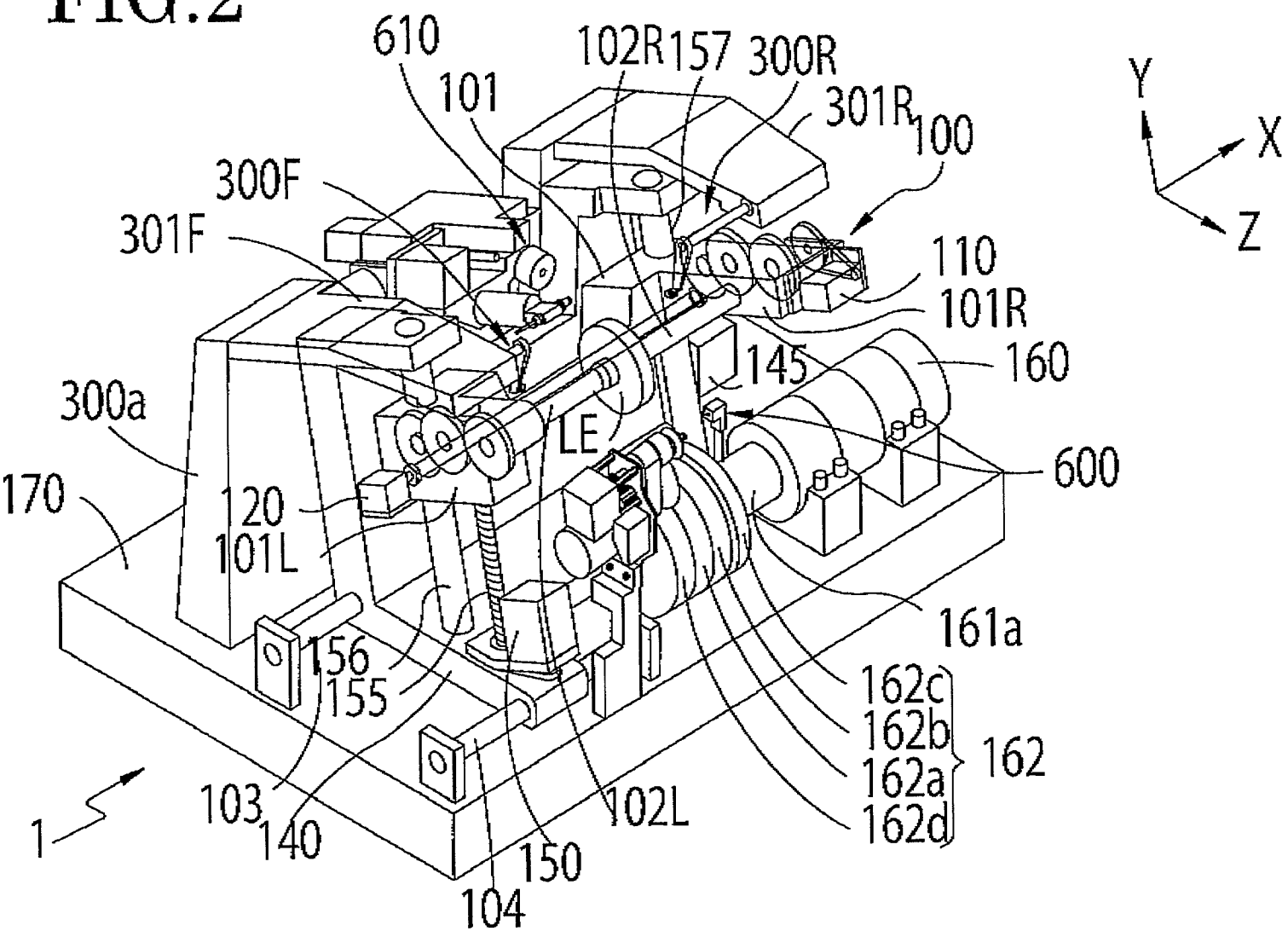
FIG. 2 is a schematic configuration diagram showing a lens processing portion disposed in a housing of a processing apparatus body.

FIG. 2 is a perspective diagram showing a schematic configuration of a lens processing portion disposed in a housing of the processing apparatus body 1. A carriage portion 100 is mounted onto a base 170 of the processing apparatus body 1, and the peripheral edge of a lens LE to be processed, which is interposed between lens chuck shafts (lens rotary shafts) 102R and 102L constituting a carriage 101 is processed by a grindstone group 162 attached to a grindstone spindle 161*a* in a press-contact state. The grindstone group 162 includes a roughing grindstone 162*a* for plastic, a finishing grindstone 162*b* having a beveling groove and a flat processing surface, a polishing grindstone 162*c*, and a roughing grindstone 162*d* for glass. The grindstone spindle (grindstone rotary shaft) 161*a* is rotated by a motor 160. The finishing grindstone 162*b* and the polishing grindstone 162*c* have a bevel forming groove and a flat finishing plane surface, respectively.

The lens chuck shaft 102L and the lens chuck shaft 102R are rotatably and coaxially held in a left arm 101L and a right arm 101R of the carriage 101, respectively. The lens chuck shaft 102R is moved toward the lens chuck shaft 102L by a motor 110 attached to the right arm 101R, and the lens LE is held between the two lens chuck shafts 102R and 102L (as a lens chuck mechanism, a general mechanism may be used). The two lens chuck shafts 102R and 102L are rotated in a synchronizing-manner by a motor 120 attached to the left arm 101L via a rotation transmission mechanism such as a gear.

The carriage 101 is mounted to a support base 140 which is movable in an X direction along shafts 103 and 104 extending in parallel to the lens chuck shafts 102R, 102L and the grindstone spindle 161*a*. A ball screw (not shown) extending in parallel to the shaft 103 is attached to a rear portion of the support base 140. When a motor 145 rotates, the carriage 101 is linearly moved in an X direction together with the support base 140.

Additionally, shafts 156 and 157 extending in a Y direction (a direction in which a distance between the shafts of the lens chuck shafts 102R, 102L and the grindstone spindle 161*a* varies) are fixed to the support base 140. The carriage 101 is mounted to the support base 140 so as to be movable in a Y direction along the shafts 156 and 157. A motor 150 for a movement in a Y direction is fixed to the support base 140. A rotation of the motor 150 is transmitted to a ball screw 155 extending in a Y direction, and the carriage 101 is moved in a Y direction in terms of a rotation of the ball screw 155.

Figure 3:
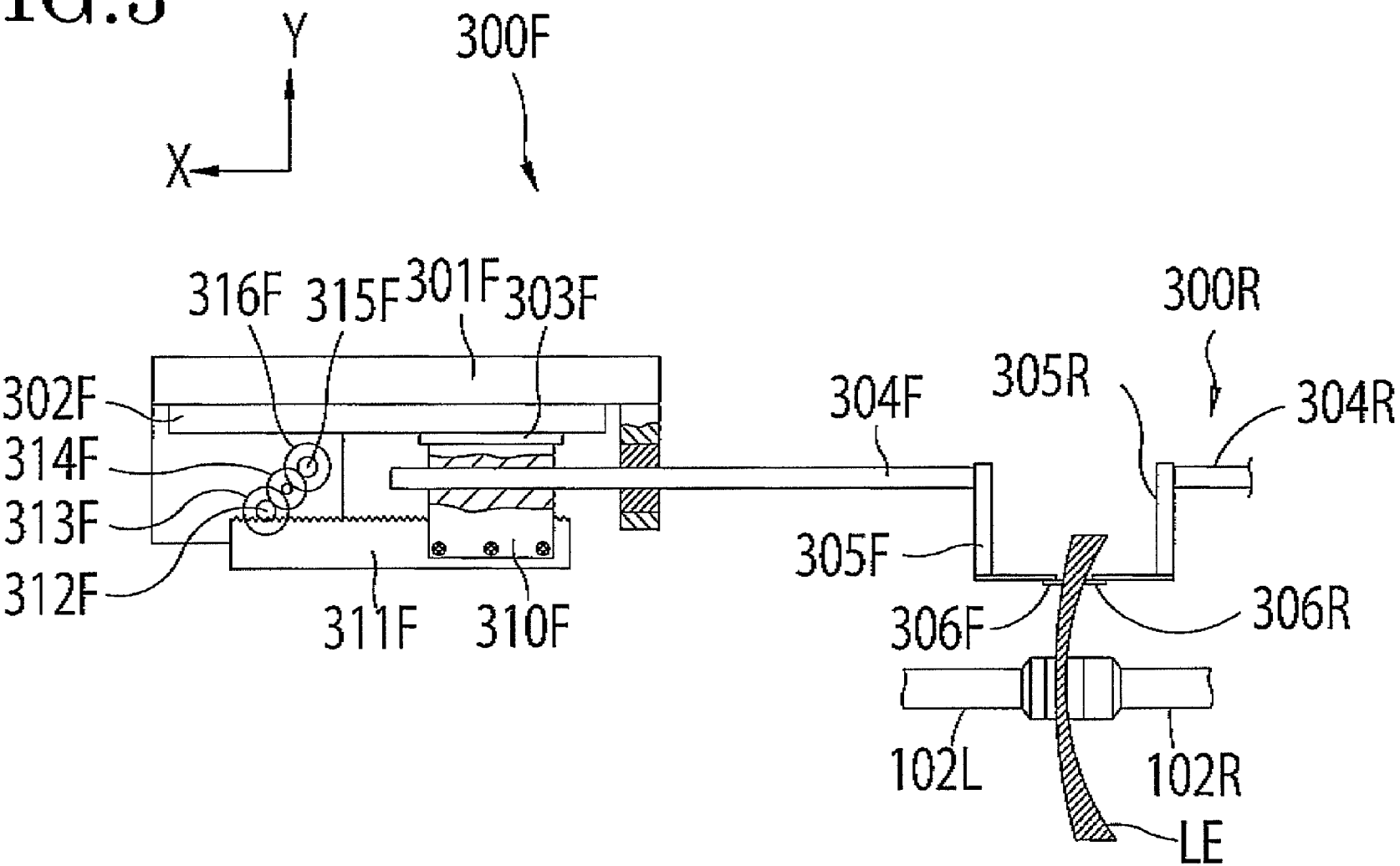
FIG. 3 is a schematic configuration diagram showing a lens shape measurement portion.

In FIG. 2, lens shape measurement portions (lens edge position measurement portions) 300F and 300R are provided above the carriage 101. FIG. 3 is a schematic configuration diagram showing the measurement portion 300F for measuring an edge position of a front refractive surface of the lens. An attachment support base 301F is fixed to a support base block 300*a* fixed to the base 170 shown in FIG. 2, and a slider 303F is slidably attached to a rail 302F fixed to the attachment support base 301F. A slide base 310F is fixed to the slider 303F, and a measurement member arm 304F is fixed to the slide base 310F. An L-shaped hand 305F is fixed to the front end portion of the measurement member arm 304F, and a measurement member 306F is fixed to the front end portion of the hand 305F. The measurement member 306F is brought into contact with a front refractive surface of the lens LE.

A rack 311F is fixed to the lower end portion of the slide base 310F. The rack 311F engages with a pinion 312F of an encoder 313F fixed to the attachment support base 301F. Additionally, a rotation of a motor 316F is transmitted to the rack 311F via a gear 315F, an idle gear 314F, and a pinion gear 312F so that the slide base 310F is moved in an X direction. While the lens shape is measured, at a normal time, the motor 316F presses the measurement member 306F against the lens LE at a constant force. The encoder 313F detects a movement position of the slide base 310F in an X direction. In terms of movement position information, rotation angle information of the lens chuck shafts 102L, 102R, and Y-direction movement information, the front refractive surface shape (the edge position of the front surface of the lens) of the lens LE is measured.

Since the configuration of the measurement portion 300R for measuring the rear refractive surface shape of the lens LE is symmetrical with respect to that of the measurement portion 300F, 'F' is exchanged with 'R' in the reference numerals of the respective components shown in FIG. 3, and the description thereof will be omitted.

Figure 4:
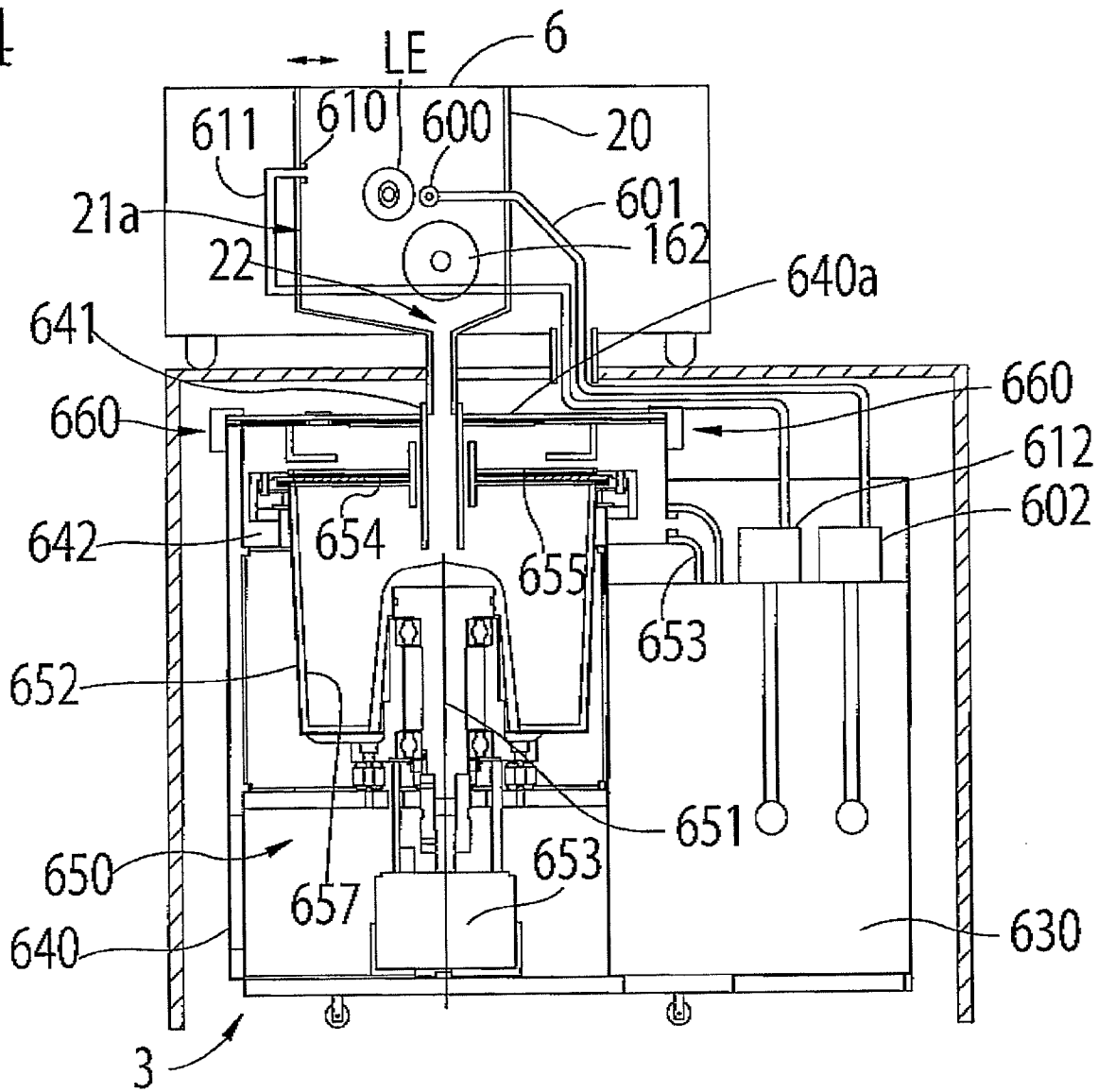
FIG. 4 is an explanatory diagram showing a water supply mechanism and a centrifugal separator as a filter device.

Next, a water supply mechanism for supplying grinding water and cleaning water to the processing apparatus body 1 and a filtering device for filtering the grinding water discharged from the processing apparatus body 1 after the processing of the lens will be described with reference to FIGS. 2 and 4. FIG. 4 is an explanatory diagram showing the water supply mechanism and the filtering device.

In FIGS. 2 and 4, a side wall of a processing chamber 20 having therein the grindstone group 162 is provided with a nozzle 600 for ejecting the grinding water to a contact portion between the grindstone 162 and the lens LE. An ejection port of the nozzle 600 faces a direction in which the ejected grinding water goes past by a surface of the grindstone 162. An inner wall 21*a* on the inner side (left side of FIG. 3) of the processing chamber 20 is provided with a nozzle 610 for ejecting the cleaning water cleaning the inside of the processing chamber. The nozzle 610 is provided above the grindstone 162. The water is ejected downward from the nozzle 610 so as to clean processing refuse flying to the wall surface due to a rotation of the grindstone 162 during the processing of the lens. Drainage containing the processing refuse is discharged from a drainage port 22 provided in the bottom surface of the processing chamber 20 via the drainage pipe 3*a*.

A tube 601 is connected to the nozzle 600, and the tube 601 is connected to a pump 602 (a grinding water supply unit), thereby sucking the water filled in a tank 630 using the pump 602. Additionally, a tube 611 is connected to the nozzle 610, and the tube 611 is connected to a pump 612, thereby sucking the water filled in the tank 630 using the pump 602.

A filtering mechanism of the grinding water will be described. A housing 640 of the water treatment device 3 is provided with the centrifugal separator 650 as a drainage filtering mechanism. The centrifugal separator 650 includes a rotary shaft 651 and a dewatering bin 652 fixed to the rotary shaft 651. In the bottom portion of the dewatering bin 652, a center portion thereof is configured to be higher than a periphery portion thereof. Accordingly, since a height of the center portion of the dewatering bin 652 is higher as compared with a case in which a height of the bottom portion of the dewatering bi is uniform, it is possible to improve the stability of the dewatering bin 652 during the rotation. A driving motor 653 is attached to the lower side of the housing 640, and is rotatably connected to the dewatering bin 652 via a rotary shaft 651. The upper portion of the dewatering bin 652 is provided with an annular filter 654 for performing a filtering operation by separating the water from the drainage containing the processing refuse. The filter 654 has a mesh structure in which the water is transmitted and the processing refuse are hardly transmitted. The filter 654 is fixed to the upper portion of the dewatering bin 652 via a fixed member 655. Additionally, the inner wall and the bottom surface of the dewatering bin 652 are provided with a collection member 657 made of nonwoven for facilitating an extraction operation of the processing refuse.

The upper portion of the housing 640 is attached with an openable upper cover 640*a* located above the dewatering bin 652. The drainage pipe 3*a* of the processing apparatus body 1 is connected to a drainage pipe 641 attached to the upper cover 640*a*. The drainage pipe 641 is located at a rotation center of the centrifugal separator 650. The upper cover 640*a* serves as a member for receiving the water discharged from the filter 654 and for receiving the water bouncing and flying from a gap formed between the fixed member 655 and the drainage pipe 641 so as to be guided to the downside. A water collection case 642 is provided in the outside of the dewatering bin 652 so as to surround the dewatering bin 652. The water received in the water collection case 642 is introduced into the tank 630 via a pipe 653.

Figure 5:
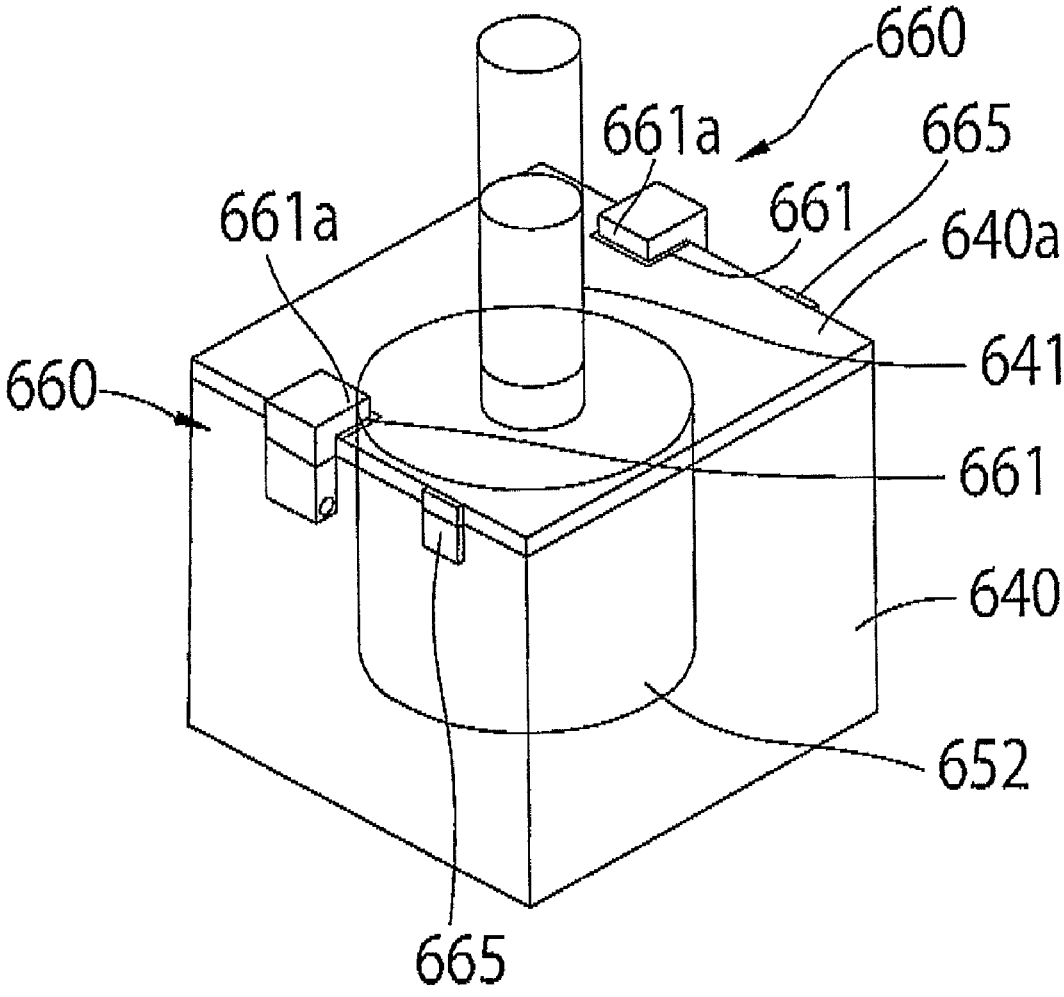
FIG. 5 is an explanatory diagram showing a lock mechanism.

The upper cover 640*a* is fixed to the housing 640 by use of a lock mechanism 660. FIG. 5 is an explanatory diagram showing the lock mechanism 660. The lock mechanism 660 has an inverse L-shaped key plate 661 rotatable about a support point supported to a side surface of the housing 640. When the upper surface of the upper cover 640*a* is pressed by a nail portion 661*a* formed in the upper portion of the key plate 661, the upper cover 640*a* is fixed to the housing 640. Additionally, the housing 640 is attached with a micro switch 665 (open/close detection unit) for detecting an open/close state of the upper cover 640*a*.

A drainage filtering operation using the centrifugal separator 650 will be described. The water containing the processing refuse from the processing apparatus body 1 is introduced into the dewatering bin 652 of the centrifugal separator 650 via the drainage pipe 641. Due to the rotation of the dewatering bin 652, the drainage is influenced by a centrifugal force of the dewatering bin 652. The processing refuse are sent to the outer periphery of the dewatering bin 652 in terms of a reaction of the centrifugal force, and are collected in a direction from the outer periphery of the dewatering bin 652 to the inner periphery thereof. At this time, the water from which the processing refuse each having a large specific gravity (processing refuse having a large particle) are separated is sent to the upside of the dewatering bin 652 and is filtered by the filter 654. The water, from which the processing refuse each having a small particle are separated by the filter 654, is collected in the water collection case 642. Additionally, the water which is not completely filtered by the filter 654 bounces and flies from a gap formed between the fixed member 655 and the drainage pipe 641, and is received in the water collection case 642. The water collected in the water collection case 642 is introduced into the tank 630 via a pipe 643.

Figure 6:
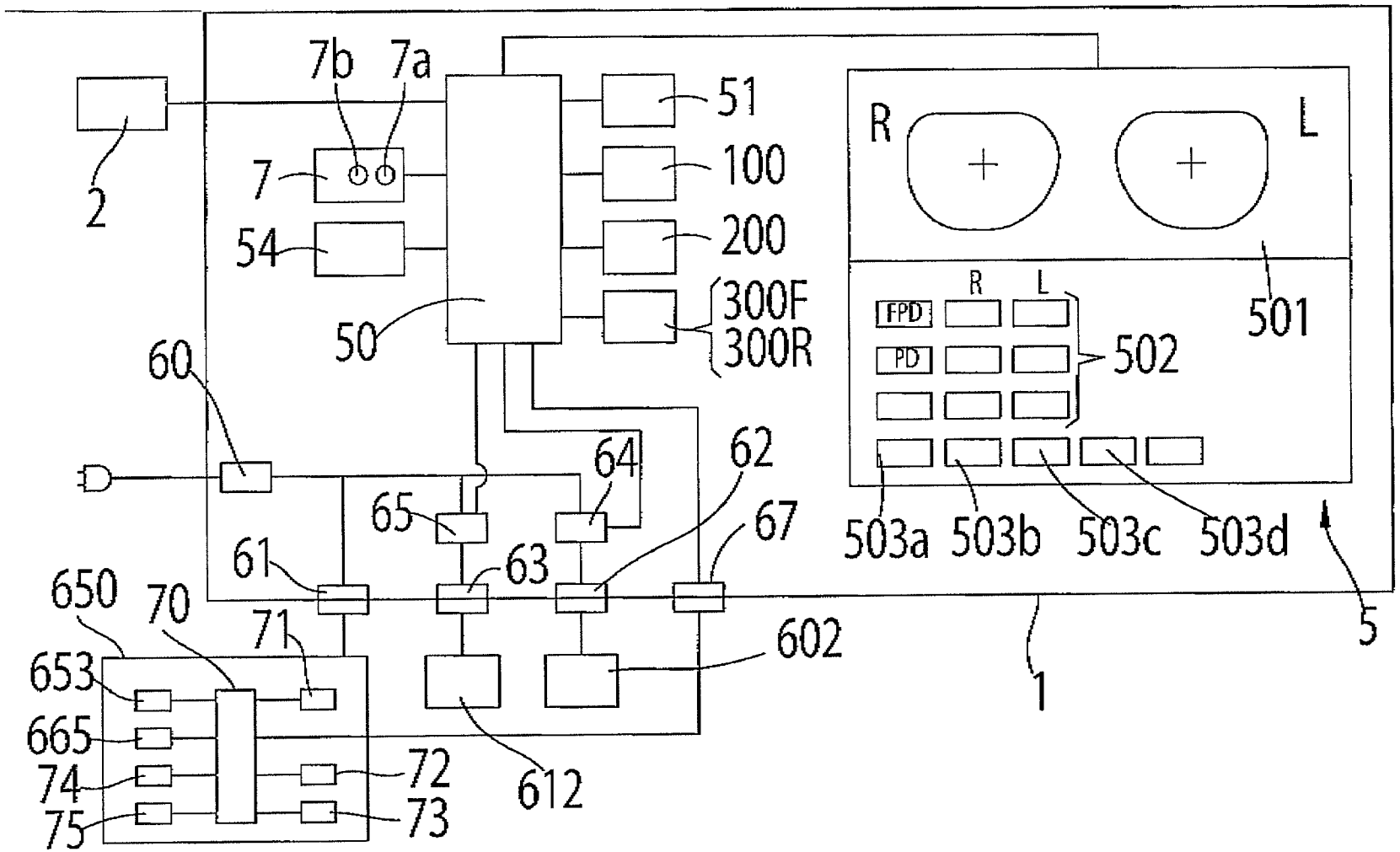
FIG. 6 is a block diagram showing a water treatment control system having the processing apparatus body and the centrifugal separator.

FIG. 6 is a block diagram showing a water treatment control system having the centrifugal separator 650 and the processing apparatus body 1. When a power supply switch 60 is turned on, electric power is supplied to the processing apparatus body 1. A power supply cable of the centrifugal separator 650 is connectable to a power supply outlet 61 provided in the processing apparatus body 1, and hence the electric power is supplied to the centrifugal separator 650 by turning on the power supply switch 60. The processing apparatus body 1 is provided with power supply outlets 62 and 63 to which power supply cables of the pumps 602 and 612 are connected. Switches 64 and 65 are provided in the course of the power supply lines to the power supply outlets 62 and 63, respectively. Each driving of the pumps 602 and 612 is carried out in such a manner that a control unit 50 of the processing apparatus body 1 turns on/off the switches 64 and 65. The control unit 50 is connected to the eyeglass frame shape measurement device 2, the display unit 5, the switch unit 7, and an eyeglass shape data memory 51. Additionally, the control unit 50 is connected to the carriage portion 100 and the lens edge position measurement portions 300F and 300R.

A control unit 70 of the centrifugal separator 650 is connected to the control unit 50 via a signal connection gate 67. The control unit 70 is connected to the motor 653, the micro switch 665, a memory 71 for storing the number of the processed lenses, an indicator 72 for displaying the number of the processed lenses, a buzzer 73 for generating an alarm sound, a reset switch 74 for resetting the information on the number of the processed lenses stored in the memory 71, and a switch 75 for stopping the alarm sound of the buzzer 73. Additionally, the indicator 72 and the reset switch 74 are arranged so as to be opposed to the housing 640 (which are not shown in FIG. 1).

An operation of the apparatus with the above-described configuration will be described. First, when the power supply switch 60 of the processing apparatus body 1 is turned on, the electric power is supplied to the apparatus body 1 and the electric power is supplied to the centrifugal separator 650 via the power supply outlet 61 in a manner interlocked with the operation in which the power supply switch 60 is turned on. Accordingly, it is possible to prevent a case in which electric power is not supplied to the centrifugal separator 650 (filter device). Additionally, the electric power supplied to the centrifugal separator 650 via the power supply outlet 61 is turned OFF in a manner interlocked with an operation in which the power supply switch 60 is turned off.

Here, when the power supply cable of the centrifugal separator 650 is connected to a power supply different from that of the processing apparatus body 1, it is necessary to provide a power supply switch in the centrifugal separator 650. In this case, when the processing apparatus body 1 starts the processing of the lens without supplying the electric power to the centrifugal separator 650, the dirty drainage of the processing apparatus body 1 overflows from the dewatering bin 652, and also the processing refuse accumulated in the dewatering bin 652 overflows therefrom. Accordingly, the flowing drainage is very dirty. In case of a circulation type, the water containing a large amount of the processing refuse is accumulated in the tank 630, and the grinding water containing a large amount of the processing refuse is again supplied to the processing apparatus body 1. When a large amount of the processing refuse is contained in the grinding water, particularly, it is difficult to maintain the precision of the processing surface during a precise finishing such as a polish-finishing. On the contrary, since the electric power is configured to be supplied from the processing apparatus body 1 to the centrifugal separator 650, it is possible to avoid such a problem.

Upon processing the peripheral edge of the lens, an operator inputs a processing condition for the lens. When a switch of the switch unit 7 is pressed, the eyeglass shape data of the eyeglass frame (dummy lens or template) measured by the frame shape measurement device 2 is input and stored in the memory 51. The figure of the eyeglass shape is displayed on a screen 501 of the display unit 5. Accordingly, a layout data such as a wearer's pupillary distance (PD value) and a height of an optical center with respect to the center of the eyeglass shape can be input in terms of an operation of a button key 502. In terms of a lens material selection button key 503*a*, plastic, polycarbonate, trivex, acryl, glass, and the like can be selected as the material of the lens. In terms of a button key 503*b*, any one of a bevel-processing mode, a plane-processing mode, and a grooving mode can be selected. In terms of a button key 503*c*, it is possible to select whether the polishing is carried out. In terms of a button key 503*d*, it is possible to select whether the chamfering is carried out.

The operator inputs the processing condition and the layout data, and holds the lens LE between the lens chuck shafts 102L and 102R. When a lens chuck signal (lens interposing start signal) is input by a chuck switch 7*a* disposed in the switch unit 7, the motor 110 is driven, and the lens chuck shaft 102R is moved toward the lens chuck shaft 102L, thereby holding the lens LE using the two lens chuck shafts 102R and 102L. Subsequently, when a start switch 7*b* disposed in the switch unit 7 is pressed, the switch signal is input as a signal for starting the lens shape measurement.

A lens shape measurement operation using the lens shape measurement portions 300F and 300R will be simply described. When the carriage 101 is moved, the lens LE is moved to a position between the measurement member 306F and the measurement member 306R. When the motor 316F is driven, the measurement member 306F comes into contact with the front surface of the lens. When a motor (not shown) is driven, the measurement member 306R comes into contact with the rear surface of the lens. In this state, the carriage 101 is moved in a Y direction on the basis of the eyeglass shape data, thereby rotating the lens LE. At this time, an X-direction movement position with respect to the rotation angle of the lens is detected by the encoders 313F and an encoder (not shown), thereby simultaneously measuring the front and rear surface edge position data of the lens. The front and rear surface measurement data of the lens is used to check whether a diameter of the lens held between the lens chuck shafts is sufficient for the eyeglass shape and used for a bevel meridian in which a bevel top is disposed in accordance with the edge position during the bevel processing. A detailed configuration and a measurement operation of the lens shape measurement portions 300F and 300R are disclosed in U.S. Pat. No. 6,790,124.

As a result of the lens shape measurement, when the diameter of the lens is sufficient, a bevel path is calculated on the basis of the front and rear surface edge positions of the lens so as to dispose the bevel top position in the peripheral edge of the lens. As a bevel path calculation, the calculation is carried out so that the edge thickness is divided into a predetermined ratio (for example, 3:7) in the whole periphery.

When a compulsory bevel processing mode is set, a simulation screen capable of checking and changing the bevel position is displayed on the display unit 5. Since the figure of the eyeglass shape is displayed on the simulation screen, when a certain position of the eyeglass shape is selected, a bevel sectional shape at the selected position is displayed. The operator can check a state where the bevel is formed in the whole periphery of the lens in terms of the simulation screen, and can change a shift position of an edge or a bevel curve.

When the start switch 7*b* is pressed again after checking the bevel position, the switch signal is input as a signal for starting the processing of the lens. Additionally, when an automatic processing mode is set, the bevel path is automatically determined in terms of the bevel path calculation, and the processing of the lens starts (that is, after the bevel path calculation ends, the processing start signal is automatically input by the control unit 50). The roughing is performed to the peripheral edge of the lens by use of the roughing grindstone 162*a* in such a manner that the movement of the carriage 101 and the rotation of the lens are controlled on the basis of the first roughing data (the eyeglass shape has an extra portion to be processed during the finishing). Subsequently, the finishing is carried out by use of the finishing grindstone 162*b* in such a manner that the movement of the carriage 101 in X and Y directions and the rotation of the lens are controlled on the basis of the bevel path data. Subsequently, the pumps 602 and 612 are driven on the basis of the processing start signal of the lens as the trigger signal, and the grinding water and the cleaning water start to be supplied from the nozzle 600 and the nozzle 610, respectively. The processing refuse produced during the processing of the lens are flown together with the grinding water (and the cleaning water). The drainage is discharged from the drainage port 22 of the processing chamber 20 to the inside of the dewatering bin 652 of the centrifugal separator 650 via the pipe 3*a*.

Here, as a driving start (a rotation start of the motor 653) signal of the centrifugal separator 650, the processing start signal of the lens is not used as the trigger signal, but the lens shape measurement start signal, input in advance, is used as the trigger signal. In terms of the lens shape measurement start signal, the control unit 50 transmits a signal for operating the centrifugal separator 650 to the control unit 70, and the control unit 70 starts the motor 653 to be driven so that the dewatering bin 652 starts to rotate. This is because it takes time until the rotating speed of the dewatering bin 652 becomes maximum. Particularly, if the processing refuse is collected in the dewatering bin 652 and hence the whole weight is large, even when the dewatering bin 652 is rotated by driving the motor 653, it takes time (5 to 10 sec) until the rotating speed becomes maximum. When the drainage containing the processing refuse is introduced into the dewatering bin 652 at a stage when the rotating speed of the dewatering bin 652 is not sufficiently fast, the filtering efficiency low, and thus the drainage from which the processing refuse are not sufficiently separated may easily overflow therefrom. Additionally, since a large amount of the processing refuse arrives at the filter 654, an exchange cycle of the filter 654 becomes short.

Therefore, when the dewatering bin 652 starts to rotate at a stage when the lens shape measurement starts before the processing of the lens (before the supply of the grinding water), since it takes time to measure the lens shape, the rotating speed of the dewatering bin 652 becomes the rotating speed for efficiently performing the centrifugal separation at a stage when the lens shape measurement ends. Additionally, since the motor 653 starts to rotate at an earlier stage before the processing of the lens starts, it is not necessary to use the driving motor 653 with high responsibility, thereby providing the centrifugal separator 650 with high filtering efficiency using a low-cost configuration.

In addition, as a signal for starting the centrifugal separator 650 to be driven before the processing of the lens, the lens chuck signal generated by the chuck switch 7*a* upon holding the lens between the lens chuck shafts 102R and 102L may be used as the trigger signal.

When the processing of the peripheral edge of the lens ends, the supply of the grinding water (and the cleaning water) stops. At this time, the rotation of the centrifugal separator 650 (the dewatering bin 652) does not stop right away, but continues for a predetermined extra time T (for example, 2 minutes) after the processing of the lens ends by use of the timer function of the control unit 70. The supply of the grinding water (and the cleaning water) stops when the processing of the lens ends, but since the grinding water remains in the dewatering bin 652, it takes time to sufficiently perform the dewatering operation. Since the centrifugal separator 650 is rotated for a predetermined extra time by considering a time necessary for the dewatering operation even after the supply of the grinding water (and the cleaning water) stops, the dewatering operation of the drainage remaining in the dewatering bin 652 is carried out. Accordingly, even when the drainage is introduced into the dewatering bin 652 at the next processing of the lens, the dirty drainage is not discharged. Additionally, when the processing refuse are extracted from the dewatering bin 652, since the processing refuse are sufficiently dewatered, it is possible to facilitate the processing refuse extraction operation and the processing refuse disposal. When the processing refuse contain a large amount of moisture, since the weight of the processing refuse is large, particularly, a female operator cannot easily extract the processing refuse, and her hands may get dirty. When the dewatering operation of the processing refuse is sufficiently carried out, such problems are reduced.

When the processing of the lens ends, the control unit 50 transmits the processing end signal to the control unit 70 of the centrifugal separator 650, and the control unit 70 counts the number of the processed lenses so as to update the number of the processed lenses stored in the memory 71. The level of the number of the processed lenses is displayed on the indicator 72. When a large number of the lenses are processed, a large amount of the processing refuse are accumulated in the dewatering bin 652 of the centrifugal separator 650. When a large amount of the processing refuse are collected in the dewatering bin 650, the filtering efficiency of the centrifugal separator 650 considerably deteriorates. When the processing of the lens continues at the low filtering efficiency, and the drainage containing the processing refuse is introduced into the dewatering bin 652, the drainage from which the processing refuse are not separated flows to the tank 630. When the plastic lens is processed and the drainage from which the processing refuse are not separated flows to the tank 630, bubbles are generated from the tank 630. Additionally, when the drainage of the plastic lens flows to the tank 630, bubbles overflow from the tank 630. When the grinding water which is not sufficiently filtered is supplied for the processing of the lens, particularly, it is not possible to perform the polishing to the lens surface with high precision. For this reason, it is necessary to extract the processing refuse collected in the dewatering bin 652 before the filtering efficiency considerably deteriorates.

Therefore, when the number of sheets of the processed lenses stored in the memory 71 becomes the predetermined number N (or becomes close to the predetermined number N), the control unit 70 generates a signal (alarm signal) for driving the buzzer 73 so as to alarm that the processing refuse collected in the dewatering bin 652 need to be extracted in terms of the buzzer 73. Additionally, in the level displayed on the indicator 72, the color of the level changes in accordance with a ratio between the number of the processed lenses and the predetermined number N. For example, when the number of the processed lenses is less than 70% of the predetermined number N, the green level is displayed. When the number of the processed lenses is 70% to 90% of the predetermined number N, the orange level is displayed. When the number of the processed lenses is not less than 90% of the predetermined number N, the red level is displayed. Accordingly, it is possible to visually check how much the processing refuse are collected in the dewatering bin 652 and whether the extraction of the processing refuse is necessary. The predetermined number N as the reference number of the processed lenses to be extracted (that is, the multiplied amount of the processing refuse) is set in advance by an experiment. Although the amount of the processing refuse produced for the processed lens is different in accordance with the eyeglass shape or the lens thickness, the amount may be calculated from the average, and the predetermined number N desirably needs to be set with some allowance. The predetermined number N set as the processing refuse extraction reference is stored in the memory 71*a*. In terms of the alarm sound of the buzzer 73, the operator can appropriately determine the processing refuse extraction timing.

The alarm sound of the buzzer 73 is stopped by pressing the switch 75. When the processing refuse are extracted from the dewatering bin 652, the upper cover 640*a* is opened upward, the filter 654 is separated, and then the collection member 657 is lifted, thereby extracting the processing refuse. After the processing refuse are extracted, the operator sets the collection member 657 and the filter 654 again, and closes the upper cover 640*a*. Subsequently, it is detected whether the cover 640*a* is opened by use of the micro switch 665, and the detection signal is input to the control unit 70. Subsequently, the sheets of the processed lenses stored in the memory 71 is reset by pressing the reset switch 74. In this manner, the reset signal is input in terms of an interlocking between the micro switch 665 and the reset switch 74.

Here, the control unit 70 enables the reset of the number of the processed lenses by use of the reset switch 74 for a predetermined period (for example, for 2 minutes) after the open/close state of the cover 640*a* is detected by the micro switch 665. At a time other than the predetermined period, even when the reset switch 74 is pressed, the number of the processed lenses stored in the memory 71 is not reset. Accordingly, it is possible to prevent a case as much as possible, in which the reset switch 74 is pressed by mistake to thereby reset the number of the processed lenses. Additionally, in order for the operator to reset the number of the processed lenses, the reset switch 74 needs to be simply operated and the reset of the number of the processed lenses needs to be carried out after performing the processing refuse extraction operation. Accordingly, it is possible to compulsorily perform the processing refuse extraction operation. In the example of the present apparatus, in order to reset the number of the processed lenses, it is necessary to separate one end of the cover 640*a* on purpose. When the cover 640*a* is separated, as the next operation, the processing refuse may be extracted from the dewatering bin 652. Accordingly, it is possible to prevent a case as much as possible, in which the operation continues in a state where the number of the processed lenses becomes the predetermined number N and a large amount of the processing refuse are collected in the dewatering bin 652.

Additionally, when the alarm sound of the buzzer 73 is stopped by pressing the switch 75, but the number of the processed lenses is not reset, the alarm sound is generated again from the buzzer 73 after the processing of the next lens. For this reason, the operator has no choice but to reset the number of the processed lenses since it takes trouble to stop the alarm sound by pressing the switch 75 when the processing of the lens continues without resetting the number of the processed lenses.

In the above-described configuration, the centrifugal separator 650 has the counting function for counting the number of the processed lenses, the memory for storing the number of the processed lenses, the buzzer for generating the alarm sound, the switch for stopping the alarm sound, the reset switch, and the display function for displaying the number of the processed lenses, but the processing apparatus body 1 may be configured to have them. That is, the control unit 50 counts the number of the processed lenses, and the counted number of the processed lenses is stored in the memory 51 to be displayed on the display unit 5. Additionally, the reset switch and the stop switch for stopping the alarm sound are provided in the display unit 5, and the signals thereof are input to the control unit 50 so that the control unit 50 controls an alarm sound generating unit provided in the processing apparatus body 1. As described above, in a case in which the control unit 50 of the processing apparatus body 1 controls the water treatment device 3, it may be configured such that the power supply of the water treatment device 3 is separately provided from that of the processing apparatus body 1. When the above-described various controls of the control unit 50 is performed to the water treatment device 3 being in a standby state, and the sensor signal of the water treatment device 3 is fed back to the control unit 50, it is not necessary to provide the control unit in the water treatment device 3, thereby obtaining the water treatment device 3 at a low cost.

As described above, in order to alarm that the processing refuse collected in the dewatering bin 652 need to be extracted, the number of the processed lenses is used as a data for indicating the multiplied amount of the processing refuse discharged from the processing apparatus body 1. However, since the data indicating the multiplied amount of the processing refuse is used as the extraction timing reference of the processing refuse collected in the dewatering bin 652, an approximate data is enough for the reference. Accordingly, it is efficient to adopt data such as the outer diameter of the material lens, the thickness of the lens, and the eyeglass shape as well as the number of the processed lenses.

Additionally, it should be understood that the above-described embodiment may be modified into various forms by the person skilled in the art, and the modifications are included in the technical spirit of the invention.

What is claimed is:

1. An eyeglass lens processing apparatus comprising:

a processing apparatus body which includes, a lens rotation unit having a lens chuck shaft for holding and rotating a lens, a movement unit for changing an axis-to-axis distance between the lens chuck shaft and a grindstone rotating shaft by relatively moving the lens chuck shaft with respect to the grindstone rotating shaft, and a grinding water supply unit having a nozzle for ejecting grinding water to a portion to be processed of the lens;

a centrifugal separator which includes a dewatering bin for receiving the grinding water containing processing refuse via a drainage port of the processing apparatus body and a drainage pipe and a motor for rotating the dewatering bin, and which separates the processing refuse from the grinding water by rotating the dewatering bin so as to discharge the grinding water to an outside of the dewatering bin;

a calculation control unit which includes a counter for multiplying an amount of the processing refuse on the basis of a predetermined control signal of the apparatus and a memory for storing an extraction reference of the processing refuse provided to maintain filtering efficiency of the dewatering bin, and which generates an alarm signal when the multiplied processing refuse amount reaches the processing refuse extraction reference;

an alarm unit which alarms that the processing refuse collected in the dewatering bin needs to be extracted on the basis of the alarm signal by use of at least one of a buzzer and a display; and a reset signal input switch which inputs a reset signal for resetting the multiplied processing refuse amount of the counter;

wherein the counter multiplies the processing refuse amount by counting the number of the processed lenses, the number of the processed lenses being counted on the basis of the control signal; and wherein the calculation control unit generates the alarm signal indicative of a predetermined multiplied processing refuse amount lower than the processing refuse extraction reference and controls the alarm unit to alarm the predetermined multiplied processing refuse amount.

2. An eyeglass lens processing apparatus comprising:

a processing apparatus body which includes, a lens rotation unit having a lens chuck shaft for holding and rotating a lens, a movement unit for changing an axis-to-axis distance between the lens chuck shaft and a grindstone rotating shaft by relatively moving the lens chuck shaft with respect to the grindstone rotating shaft, and a grinding water supply unit having a nozzle for ejecting grinding water to a portion to be processed of the lens;

a centrifugal separator which includes a dewatering bin for receiving the grinding water containing processing refuse via a drainage port of the processing apparatus body and a drainage pipe and a motor for rotating the dewatering bin, and which separates the processing refuse from the grinding water by rotating the dewatering bin so as to discharge the grinding water to an outside of the dewatering bin;

a calculation control unit which includes a counter for multiplying an amount of the processing refuse on the basis of a predetermined control signal of the apparatus and a memory for storing an extraction reference of the processing refuse provided to maintain filtering efficiency of the dewatering bin, and which generates an alarm signal when the multiplied processing refuse amount reaches the processing refuse extraction reference;

an alarm unit which alarms that the processing refuse collected in the dewatering bin needs to be extracted on the basis of the alarm signal by use of at least one of a buzzer and a display; and a reset signal input switch which inputs a reset signal for resetting the multiplied processing refuse amount of the counter;

wherein the centrifugal separator includes an openable cover which is disposed on an upper portion of the dewatering bin and a detection unit which detects an open state of the cover, and wherein the eyeglass lens processing apparatus further comprises a reset signal input control unit which enables the input of the reset signal after the detection unit inputs a detection signal indicating that the cover is opened.

3. The eyeglass lens processing apparatus according to claim 2, wherein the reset signal input control unit enables the input of the reset signal for a predetermined period after the detection unit inputs the detection signal indicating that the cover is opened.

4. The eyeglass lens processing apparatus according to claim 2, wherein the reset signal input control unit enables the input of the reset signal for a period until a predetermined signal is input when the processing of the lens starts or for a period until a predetermined control signal for starting the processing of the lens is input, after the detection unit inputs the detection signal indicating that the cover is opened.

5. An eyeglass lens processing apparatus comprising:

a processing apparatus body which includes, a lens rotation unit having a lens chuck shaft for holding and rotating a lens, a movement unit for changing an axis-to-axis distance between the lens chuck shaft and a grindstone rotating shaft by relatively moving the lens chuck shaft with respect to the grindstone rotating shaft, and a grinding water supply unit having a nozzle for ejecting grinding water to a portion to be processed of the lens;

a centrifugal separator which includes a dewatering bin for receiving the grinding water containing processing refuse via a drainage port of the processing apparatus body and a drainage pipe and a motor for rotating the dewatering bin, and which separates the processing refuse from the grinding water by rotating the dewatering bin so as to discharge the grinding water to an outside of the dewatering bin;

a calculation control unit which includes a counter for multiplying an amount of the processing refuse on the basis of a predetermined control signal of the apparatus and a memory for storing an extraction reference of the processing refuse provided to maintain filtering efficiency of the dewatering bin, and which generates an alarm signal when the multiplied processing refuse amount reaches the processing refuse extraction reference;

an alarm unit which alarms that the processing refuse collected in the dewatering bin needs to be extracted on the basis of the alarm signal by use of at least one of a buzzer and a display; and a reset signal input switch which inputs a reset signal for resetting the multiplied processing refuse amount of the counter; and a motor control unit which starts the motor to be driven on the basis of a predetermined signal before the processing of the lens starts and allows the motor to be driven for a predetermined extra time after the processing of the lens ends.

* * * * *